US006179994B1

(12) United States Patent
Clark et al.

(10) Patent No.: US 6,179,994 B1
(45) **Date of Patent: *Jan. 30, 2001**

(54) ISOPARAFFINIC BASE STOCKS BY DEWAXING FISCHER-TROPSCH WAX HYDROISOMERATE OVER PT/H-MORDENITE

(75) Inventors: Janet R. Clark; Robert J. Wittenbrink; Daniel F. Ryan; Albert E. Schweizer, all of Baton Rouge, LA (US)

(73) Assignee: Exxon Research and Engineering Company, Florham Park, NJ (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/148,381

(22) Filed: Sep. 4, 1998

(51) Int. Cl.[7] ..... C10G 25/00

(52) U.S. Cl. ..... 208/27; 208/111.35; 208/28; 208/950; 208/134; 585/735; 585/139

(58) Field of Search ..... 208/27, 28, 111, 208/59, 134, 111.35; 585/739

(56) References Cited

U.S. PATENT DOCUMENTS

| | | | | |
|---|---|---|---|---|
| 3,539,498 | | 11/1970 | Morris et al. | 208/111 |
| 4,057,488 | | 11/1977 | Montagna et al. | 208/89 |
| 4,599,162 | * | 7/1986 | Yen | 208/111 |
| 4,724,066 | * | 2/1988 | Kiker et al. | 208/114 |
| 4,919,788 | * | 4/1990 | Chen | 208/18 |
| 4,943,672 | | 7/1990 | Hamner et al. | 585/737 |
| 4,975,177 | * | 12/1990 | Garwood et al. | 208/18 |
| 5,037,528 | * | 8/1991 | Garwood | 208/18 |
| 5,110,445 | * | 5/1992 | Chen | 208/27 |
| 5,750,819 | | 5/1998 | Wittenbrink et al. | 585/734 |
| 5,756,420 | | 5/1998 | Wittenbrink et al. | 502/313 |
| 5,833,839 | * | 11/1998 | Wittenbrink et al. | 208/27 |

FOREIGN PATENT DOCUMENTS

| | | | |
|---|---|---|---|
| 0668342 A1 | 8/1995 | (EP) | C10G/65/04 |
| 0776959 A2 | 6/1997 | (EP) | C10G/65/04 |
| WO99/20720 | 4/1999 | (WO) | C10M/143/08 |

* cited by examiner

*Primary Examiner*—Helane Myers
(74) *Attorney, Agent, or Firm*—Jonathan N. Provoost; Jay Simon

(57) ABSTRACT

A high VI and low pour point lubricant base stock is made by hydroisomerizing a high purity, waxy, paraffinic Fischer-Tropsch synthesized hydrocarbon fraction having an initial boiling point in the range of 650–750° F., followed by catalytically dewaxing the hydroisomerate using a dewaxing catalyst comprising a catalytic platinum component and an H-mordenite component. The hydrocarbon fraction is preferably synthesized by a slurry Fischer-Tropsch using a catalyst containing a catalytic cobalt component. This combination of the process, high purity, waxy paraffinic feed and the Pt/H-mordenite dewaxing catalyst, produce a relatively high yield of premium lubricant base stock.

11 Claims, 1 Drawing Sheet

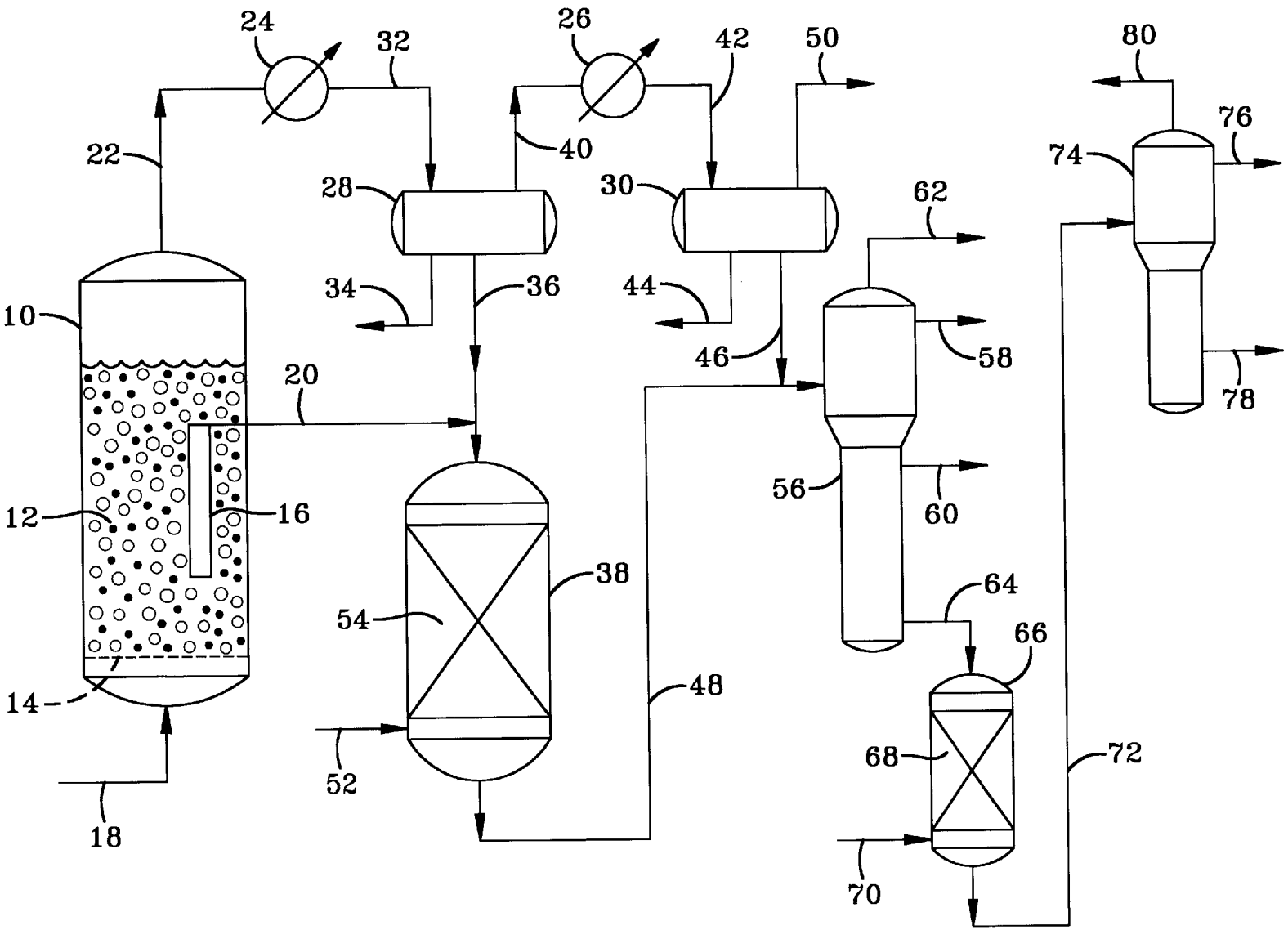
10
12
14
16
18
20
22
24
26
28
30
32
34
36
38
40
42
44
46
48
50
52
54
56
58
60
62
64
66
68
70
72
74
76
78
80

ISOPARAFFINIC BASE STOCKS BY DEWAXING FISCHER-TROPSCH WAX HYDROISOMERATE OVER PT/H-MORDENITE

BACKGROUND OF THE DISCLOSURE

1. Field of the Invention

The invention relates to a process for producing a premium, synthetic lubricant base stock produced from waxy, Fischer-Tropsch synthesized hydrocarbons. More particularly the invention relates to an isoparaffinic lubricant base stock produced by hydroisomerizing a waxy, paraffinic Fischer-Tropsch synthesized hydrocarbon fraction and catalytically dewaxing the hydroisomerate with a Pt/H-mordenite dewaxing catalyst.

2. Background of the Invention

Current trends in the design of automotive engines require higher quality crankcase and transmission lubricating oils having a high viscosity index (VI) and low pour point. While high VI's have typically been achieved with the use of VI improvers as additives to the oil, additives are expensive and tend to undergo degradation from the high engine temperatures and shear rates. Processes for preparing lubricating oils of low pour point from petroleum derived feeds typically include atmospheric and/or vacuum distilling a crude oil to recover fractions boiling in the lubricating oil range, solvent extracting the lubricating oil fractions to remove aromatics and form a raffinate, hydrotreating the raffinate to remove heteroatom compounds and aromatics, followed by either solvent or catalytically dewaxing the hydrotreated raffinate to reduce the pour point of the oil. More recently it has been found that good quality lubricating oils can be formed from hydrotreated slack wax and Fischer-Tropsch wax.

Fischer-Tropsch wax is a term used to describe waxy hydrocarbons produced by a Fischer-Tropsch hydrocarbon synthesis processes, in which a synthesis gas feed comprising a mixture of $H_2$ and CO reacts in the presence of a Fischer-Tropsch catalyst, under conditions effective to form hydrocarbons. U.S. Pat. No. 4,963,672 discloses a process for converting waxy Fischer-Tropsch hydrocarbons to a lubricant base stock having a high VI and a low pour point by sequentially hydrotreating, hydroisomerizing, and solvent dewaxing. A preferred embodiment comprises sequentially (i) severely hydrotreating the wax to remove impurities and partially convert the 1050° F.+ wax, (ii) hydroisomerizing the hydrotreated wax with a noble metal on a fluorided alumina catalyst, (iii) hydrorefining the hydroisomerate, (iv) fractionating the hydroisomerate to recover a lube oil fraction, and (v) solvent dewaxing the lube oil fraction to produce the base stock. European patent publication EP 0 668 342 A1 suggests a processes for producing lubricating base oils by hydrogenating and then hydroisomerizing a waxy Fischer-Tropsch raffinate, followed by dewaxing. The hydrogenating is performed without cracking to lower the hydroisomerization temperature and increase the catalyst life, both of which those skilled in the art know are adversely effected by the presence of oxygenates and heteroatoms in the waxy feed. EP 0 776 959 A2 recites hydroconverting Fischer-Tropsch hydrocarbons having a narrow boiling range, fractionating the hydroconversion effluent into heavy and light fractions and then dewaxing the heavy fraction to form a lubricating base oil having a VI of at least 150.

SUMMARY OF THE INVENTION

A premium, synthetic, isoparaffinic lubricant base stock having a high VI and a low pour point is made from a high purity, paraffinic, waxy Fischer-Tropsch synthesized hydrocarbon feed having an initial boiling point in the range of from 650–750° F. (650–750° F.+), by hydroisomerizing the feed and catalytically dewaxing the 650–750° F.+ hydroisomerate with a dewaxing catalyst comprising a catalytic platinum component, and the hydrogen form of mordenite (hereinafter, "Pt/H-mordenite"). By lubricant is meant a formulated lubricating oil, grease and the like. Fully formulated lubricating oils, made by forming an admixture of one or more lubricant additives and the base stock of the invention, have been found to perform at least as well as, and often superior to, formulated lubricating oils employing either a petroleum oil or PAO (polyalphaolefin) derived base stock. By 650–750° F.+ is meant that fraction of the hydrocarbons synthesized by the Fischer-Tropsch process having an initial boiling point in the range of from 650–750° F., preferably continuously boiling up to an end boiling point of at least 1050° F., and more preferably continuously boiling up to an end point greater than 1050° F. A Fischer-Tropsch synthesized hydrocarbon feed comprising this 650–750° F.+ material, will hereinafter be referred to as a "waxy feed". By waxy is meant including material which solidifies at standard conditions of room temperature and pressure. The waxy feed also has a $T_{90}$–$T_{10}$ temperature spread of at least 350° F. The temperature spread refers to the temperature difference in ° F., between the 90 wt. % and 10 wt. % boiling points of the waxy feed. The use of a dewaxing catalyst comprising Pt/H-mordenite in the process of the invention has been found produce higher yields of base stock at equivalent pour point, then is typically obtained with petroleum derived materials, such as hydrotreated slack wax.

Thus, the invention relates to a process for producing a high VI, low pour point lubricant base stock from a Fischer-Tropsch synthesized waxy feed by first (i) hydroisomerizing the waxy feed to form a hydroisomerate and then (ii) catalytically dewaxing the hydroisomerate to reduce its pour point by reacting it with hydrogen in the presence of a dewaxing catalyst comprising Pt/H-mordenite, to produce a dewaxate which comprises the base stock. The hydroisomerization is achieved by reacting the waxy feed with hydrogen in the presence of a suitable hydroisomerization catalyst and preferably a dual function catalyst which comprises at least one catalytic metal component to give the catalyst a hydrogenation/dehydrogenation function and an acidic metal oxide component to give the catalyst an acid hydroisomerization function. Preferably the hydroisomerization catalyst comprises a catalytic metal component comprising a Group VIB metal component, a Group VIII non-noble metal component and an amorphous alumina-silica component. Both the hydroisomerization and the dewaxing convert some of the 650–750° F.+ hydrocarbons to hydrocarbons boiling below the 650–750° F. range (650–750° F.–). While this lower boiling material may remain in the hydroisomerate prior to dewaxing, it is removed from the dewaxate. Removal is accomplished by flashing or fractionation. Dewaxing the entire hydroisomerate means that a larger dewaxing reactor is needed and more lower boiling material must be removed from the 650–750° F.+ dewaxate, than if it was removed prior to dewaxing. The remaining 650–750° F.+ dewaxate is typically fractionated into narrow cuts to produce base stocks of differing viscosity, although the entire dewaxate may be used as a base stock, if desired. By high VI and low pour point is meant that the entire 650–750° F.+ dewaxate will have a VI of at least 110 and preferably at least 120, with a pour point less than −10° C. and preferably less than −20° C. Therefore, by lubricant base stock is meant all or a portion of the 650–750° F.+ dewaxate produced by the process of the invention.

The dewaxing is conducted to convert no more than 40 wt. % and preferably no more than 30 wt. % of the 650–750° F.+ hydroisomerate to 650–750° F.– material. In contrast to the process disclosed in U.S. Pat. No. 4,963,672 referred to above, due to the very low or nil concentration of nitrogen and sulfur compounds and the very low oxygenates level in the waxy feed, hydrogenation or hydrotreating is not required prior to the hydroisomerization and it is preferred in the practice of the invention that the waxy feed not be hydrotreated prior to the hydroisomerization. Eliminating the need for hydrotreating the Fischer-Tropsch wax is accomplished by the use of the relatively pure waxy feed, such as is produced by the slurry Fischer-Tropsch process with a catalyst comprising a cobalt catalytic component and, in a preferred embodiment, using a hydroisomerization catalyst resistant to poisoning and deactivation by any oxygenates that may be present.

BRIEF DESCRIPTION OF THE DRAWING

The FIGURE is a schematic flow diagram of a process useful in the practice of the invention.

DETAILED DESCRIPTION

The waxy feed preferably comprises the entire 650–750° F.+ fraction formed by the hydrocarbon synthesis process, with the exact cut point between 650° F. and 750° F. being determined by the practitioner, and the exact end point preferably above 1050° F. determined by the catalyst and process variables used for the synthesis. The waxy feed may also contain lower boiling material (650–750° F.–), if desired. While this lower boiling material is not useful for a lubricant base stock, when processed according to the process of the invention it is useful for fuels. The waxy feed also comprises more than 90%, typically more than 95% and preferably more than 98 wt. % paraffinic hydrocarbons, most of which are normal paraffins, and this is what is meant by "paraffinic" in the context of the invention. It has negligible amounts of sulfur and nitrogen compounds (e.g., less than 1 wppm), with less than 2,000 wppm, preferably less than 1,000 wppm and more preferably less than 500 wppm of oxygen, in the form of oxygenates. The aromatics content, if any, is less than 0.5, more preferably less than 0.3 and still more preferably less than 0.1 wt. %. Waxy feeds having these properties and useful in the process of the invention have been made using a slurry Fischer-Tropsch process with a catalyst having a catalytic cobalt component. In the practice of the invention, it is preferred that a slurry Fischer-Tropsch hydrocarbon synthesis process be used for synthesizing the waxy feed and particularly one employing a Fischer-Tropsch catalyst comprising a catalytic cobalt component to provide a high alpha for producing the more desirable higher molecular weight paraffins.

The ($T_{90}$–$T_{10}$) temperature spread of the waxy feed, while being at least 350° F., is preferably at least 400° F. and more preferably at least 450° F., and may range between 350° F. to 700° F. or more. Waxy feeds obtained from a slurry Fischer-Tropsch process employing a catalyst comprising a composite of a catalytic cobalt component and a titania have been made meeting the above degrees of paraffinicity, purity and boiling point range, having $T_{10}$ and $T_{90}$ temperature spreads of as much as 490° F. and 600° F., having more than 10 wt. % of 1050° F.+ material and more than 15 wt. % of 1050° F.+ material, with respective initial and end boiling points of 500° F.–1245° F. and 350° F.–1220° F. Both of these samples continuously boiled over their entire boiling range. The lower boiling point of 350° F. was obtained by adding some of the condensed hydrocarbon overhead vapors from the reactor to the hydrocarbon liquid filtrate removed from the reactor. Both of these waxy feeds were suitable for use in the process of the invention, in that they contained material having an initial boiling point in the range of 650–750° F., which continuously boiled to and end point of above 1050° F., and a $T_{90}$–$T_{10}$ temperature spread of more than 350° F.

The hydrogen form of mordenite, or H-mordenite as it is known, may be prepared by ion exchanging the alkali metal form with a hydrogen precursor such as ammonia, followed by calcining, or it may be converted directly to H-mordenite using an acid, such as HCl. H-mordenite of itself and composited with one or more noble metals such as platinum, is commercially available. Platinum is a preferred noble metal and therefore a dewaxing catalyst specifically comprising platinum and H-mordenite is preferred. In addition to the catalytic metal component and the H-mordenite component, the catalyst may also contain one or more metal oxide components, such as those commonly used as catalyst support materials, including one or more molecular sieves. Such materials may include, for example, any oxide or mixture of oxides such as silica which is not catalytically acidic, and acid oxides such as silica-alumina, other zeolites, silica-alumina-phosphates, titania, zirconia, vanadia and other Group IIIB, IV, V or VI oxides. The Groups referred to herein refer to Groups as found in the Sargent-Welch Periodic Table of the Elements copyrighted in 1968 by the Sargent-Welch Scientific Company. The noble metal component or components may be composited or mixed with, deposited on, impregnated into or onto, occluded or otherwise added to one or more of the other catalyst components, including the H-mordenite, either before or after they are all mixed together and extruded or pilled. The noble metal or metals may also be ion exchanged with the hydrogen in the ion exchange sites of the mordenite, as is well known. It is preferred that the one or more catalytic noble metal components be composited with, supported on or ion exchanged with, the mordenite itself. The noble metal loading, based on the combined weight of the H-mordenite and noble metal, will range from about 0.1–1.0 wt. % and preferably from 0.3–0.7 wt. %, with the noble metal preferably comprising Pt. Another noble metal Pd, may be used, in combination with the Pt. The dewaxing may be accomplished with the catalyst in a fixed, fluid or slurry bed. Typical dewaxing conditions include a temperature in the range of from about 400–600° F., a pressure of 500–900 psig, $H_2$ treat rate of 1500–3500 SCF/B for flow-through reactors and LHSV of 0.1–10, preferably 0.2–2.0. As is shown in Example 3 below, the combination of the Pt/H-mordenite dewaxing catalyst with the hydroisomerized waxy feed of the invention resulted in a lower pour point at a given conversion level, than the same catalyst with a petroleum oil derived waxy feed. This is unexpected.

Both the waxy feed and the lubricant base stock produced from the waxy feed by the process of the invention contain less heteroatom, oxygenate, naphthenic and aromatic compounds than lubricant base stocks derived from petroleum oil and slack wax. Unlike base stocks derived from petroleum oil and slack wax, which contain appreciable amounts (e.g., at least 10 wt. %) of cyclic hydrocarbons, such as naphthenes and aromatics, the base stocks produced by the process of the invention comprise at least 95 wt. % non-cyclic isoparaffins, with the remainder normal paraffins. The base stocks of the invention differ from PAO base stocks in that the aliphatic, non-ring isoparaffins contain primarily methyl branches, with very little (e.g., less than 1 wt. %)

branches having more than five carbon atoms. Thus, the composition of the base stock of the invention is different from one derived from a conventional petroleum oil or slack wax, or a PAO. The base stock of the invention comprises essentially (≧99+ wt. %) all saturated, paraffinic and non-cyclic hydrocarbons. Sulfur, nitrogen and metals are present in amounts of less than 1 wppm and are not detectable by x-ray or Antek Nitrogen tests. While very small amounts of saturated and unsaturated ring structures may be present, they are not identifiable in the base stock by presently known analytical methods, because the concentrations are so small. While the base stock of the invention is a mixture of various molecular weight hydrocarbons, the residual normal paraffin content remaining after hydroisomerization and dewaxing will preferably be less than 5 wt. % and more preferably less than 1 wt. %, with at least 50% of the oil molecules containing at least one branch, at least half of which are methyl branches. At least half, and more preferably at least 75% of the remaining branches are ethyl, with less than 25% and preferably less than 15% of the total number of branches having three or more carbon atoms. The total number of branch carbon atoms is typically less than 25%, preferably less than 20% and more preferably no more than 15% (e.g., 10–15%) of the total number of carbon atoms comprising the hydrocarbon molecules. PAO oils are a reaction product of alphaolefins, typically 1-decene and also comprise a mixture of molecules. However, in contrast to the molecules of the base stock of the invention, which have a more linear structure comprising a relatively long back bone with short branches, the classic textbook description of a PAO base stock is a star-shaped molecule, and particularly tridecane typically illustrated as three decane molecules attached at a central point. PAO molecules have fewer and longer branches than the hydrocarbon molecules that make up the base stock of the invention. Thus, the molecular make up of a base stock of the invention comprises at least 95 wt. % non-cyclic isoparaffins having a relatively linear molecular structure, with less than half the branches having two or more carbon atoms and less than 25% of the total number of carbon atoms present in the branches. Because the base stocks of the invention and lubricating oils based on these base stocks are different, and most often superior to, lubricants formed from other base stocks, it will be obvious to the practitioner that a blend of another base stock with at least 20, preferably at least 40 and more preferably at least 60 wt. % of the base stock of the invention, will still provide superior properties in many most cases, although to a lesser degree than only if the base stock of the invention is used. Such additional base stocks may be selected from the group consisting of (i) a hydrocarbonaceous base stock, (ii) a synthetic base stock and mixture thereof. By hydrocarbonaceous is meant a primarily hydrocarbon type base stock derived from a conventional mineral oil, shale oil, tar, coal liquefaction, mineral oil derived slack wax, while a synthetic base stock will include a PAO, polyester types and other synthetics.

As those skilled in the art know, a lubricant base stock is an oil possessing lubricating qualities boiling in the general lubricating oil range and is useful for preparing various lubricants such as lubricating oils and greases. Fully formulated lubricating oils (hereinafter "lube oil") are prepared by adding to the base stock an effective amount of at least one additive or, more typically, an additive package containing more than one additive, wherein the additive is at least one of a detergent, a dispersant, an antioxidant, an antiwear additive, a pour point depressant, a VI improver, a friction modifier, a demulsifier, an antifoamant, a corrosion inhibitor, and a seal swell control additive. Of these, those additives common to most formulated lubricating oils include a detergent, a dispersant, an antioxidant, an antiwear additive and a VI improver, with the others being optional, depending on the intended use of the oil. An effective amount of one or more additives or an additive package containing one or more such additives is admixed with, added to or blended into the base stock, to meet one or more specifications, such as those relating to a lube oil for an internal combustion engine crankcase, an automatic transmission, a turbine or jet, hydraulic oil, etc., as is known. Various manufacturers sell such additive packages for adding to a base stock or to a blend of base stocks to form fully formulated lube oils for meeting performance specifications required for different applications or intended uses, and the exact identity of the various additives present in an additive pack is typically maintained as a trade secret by the manufacturer. Thus, additive packages can and often do contain many different chemical types of additives and the performance of the base stock of the invention with a particular additive or additive package can not be predicted a priori. That its performance differs from that of conventional and PAO oils with the same level of the same additives is itself proof of the chemistry of the base stock of the invention being different from that of the prior art base stocks. Fully formulated lube oils made from the base stock of the invention have been found to perform at least as well as, and often superior to, formulated oils based on either a PAO or a conventional petroleum oil derived base stock. Depending on the application, using the base stock of the invention can mean that a lower concentration of additives are required for a given performance level, or a lubricant having improved performance is produced at the same additive levels.

During hydroisomerization of the waxy feed, conversion of the 650–750° F.+ fraction to material boiling below this range (lower boiling material, 650–750° F.−) will range from about 20–80 wt. %, preferably 30–70% and more preferably from about 30–60%, based on a once through pass of the feed through the reaction zone. The waxy feed will typically contain 650–750° F.− material prior to the hydroisomerization and at least a portion of this lower boiling material will also be converted into lower boiling components. Any olefins and oxygenates present in the feed are hydrogenated during the hydroisomerization. The temperature and pressure in the hydroisomerization reactor will typically range from 300–900° F. (149–482° C.) and 300–2500 psig, with preferred ranges of 550–750° F. (288–400° C.) and 300–1200 psig, respectively. Hydrogen treat rates may range from 500 to 5000 SCF/B, with a preferred range of 2000–4000 SCF/B. The hydroisomerization catalyst comprises one or more Group VIII metal catalytic components, and preferably non-noble metal catalytic component(s), and an acidic metal oxide component to give the catalyst both a hydrogenation/dehydrogenation function and an acid hydrocracking function for hydroisomerizing the hydrocarbons. The catalyst may also have one or more Group VIB metal oxide promoters and one or more Group IB metal components as a hydrocracking suppressant. In a preferred embodiment the catalytically active metal comprises cobalt and molybdenum. In a more preferred embodiment the catalyst will also contain a copper component to reduce hydrogenolysis. The acidic oxide component or carrier may include, alumina, silica-alumina, silica-alumina-phosphates, titania, zirconia, vanadia, and other Group II, IV, V or VI oxides, as well as various molecular sieves, such as X, Y and Beta sieves. It is preferred that the acidic metal oxide component include silica-alumina and particularly amorphous silica-alumina in which the silica concentration in the bulk support (as opposed to surface silica) is less than about 50 wt. % and preferably less than 35 wt. %. A particularly preferred acidic oxide component comprises amorphous silica-alumina in which the silica content ranges from 10–30 wt. %. Additional components such as silica, clays and other materials as binders may also be used. The surface area of the catalyst is in the range of from about 180–400 $m^2/g$, preferably 230–350 $m^2/g$, with a respective pore volume, bulk density and side crushing strength in the ranges of 0.3 to 1.0 mL/g and preferably 0.35–0.75 mL/g; 0.5–1.0 g/mL, and 0.8–3.5 kg/mm. A particularly preferred hydroisomerization catalyst comprises cobalt, molybdenum and, optionally, copper components, together with an amorphous silica-alumina component containing about 20–30 wt. % silica. The preparation of such catalysts is well known and documented. Illustrative, but non-limiting examples of the preparation and use of catalysts of this type may be found, for example, in U.S. Pat. Nos. 5,370,788 and 5,378,348. As was stated above, the hydroisomerization catalyst is most preferably one that is resistant to deactivation and to changes in its selectivity to isoparaffin formation. It has been found that the selectivity of many otherwise useful hydroisomerization catalysts will be changed and that the catalysts will also deactivate too quickly in the presence of sulfur and nitrogen compounds, and also oxygenates, even at the levels of these materials in the waxy feed. One such example comprises platinum or other noble metal on halogenated alumina, such as fluorided alumina, from which the fluorine is stripped by the presence of oxygenates in the waxy feed. A hydroisomerization catalyst that is particularly preferred in the practice of the invention comprises a composite of both cobalt and molybdenum catalytic components and an amorphous alumina-silica component, and most preferably one in which the cobalt component is deposited on the amorphous silica-alumina and calcined before the molybdenum component is added. This catalyst will contain from 10–20 wt. % $MoO_3$ and 2–5 wt. % CoO on an amorphous alumina-silica support component in which the silica content ranges from 10–30 wt. % and preferably 20–30 wt. % of this support component. This catalyst has been found to have good selectivity retention and resistance to deactivation by oxygenates, sulfur and nitrogen compounds found in the Fischer-Tropsch produced waxy feeds. The preparation of this catalyst is disclosed in U.S. Pat. Nos. 5,756,420 and 5,750,819, the disclosures of which are incorporated herein by reference. It is still further preferred that this catalyst also contain a Group IB metal component for reducing hydrogenolysis. The entire hydroisomerate formed by hydroisomerizing the waxy feed may be dewaxed, or the lower boiling, 650–750° F.– components may be removed by rough flashing or by fractionation prior to the dewaxing, so that only the 650–750° F.+ components are dewaxed. The choice is determined by the practitioner. The lower boiling components may be used for fuels.

While suitable Fischer-Tropsch reaction types of catalyst comprise, for example, one or more Group VIII catalytic metals such as Fe, Ni, Co, Ru and Re, it is preferred in the process of the invention that the catalyst comprise a cobalt catalytic component. In one embodiment the catalyst comprises catalytically effective amounts of Co and one or more of Re, Ru, Fe, Ni, Th, Zr, Hf, U, Mg and La on a suitable inorganic support material, preferably one which comprises one or more refractory metal oxides. Preferred supports for Co containing catalysts comprise titania, particularly. Useful catalysts and their preparation are known and illustrative, but nonlimiting examples may be found, for example, in U.S. Pat. Nos. 4,568,663; 4,663,305; 4,542,122; 4,621,072 and 5,545,674. In a slurry hydrocarbon synthesis process, which is a preferred process in the practice of the invention, a synthesis gas comprising a mixture of $H_2$ and CO is bubbled up as a third phase through a slurry in a reactor which comprises a particulate Fischer-Tropsch type hydrocarbon synthesis catalyst dispersed and suspended in a slurry liquid comprising hydrocarbon products of the synthesis reaction which are liquid at the reaction conditions. The mole ratio of the hydrogen to the carbon monoxide may broadly range from about 0.5 to 4, but is more typically within the range of from about 0.7 to 2.75 and preferably from about 0.7 to 2.5. The stoichiometric mole ratio for a Fischer-Tropsch hydrocarbon synthesis reaction is generally about 2.0, but in a slurry hydrocarbon synthesis process it is typically about 2.1/1 and may be increased to obtain the amount of hydrogen desired from the synthesis gas for other than the synthesis reaction. Slurry process conditions vary somewhat, depending on the catalyst and desired products. In the practice of the invention, it is preferred that the hydrocarbon synthesis reaction be conducted under conditions in which little or no water gas shift reaction occurs and more preferably with no water gas shift reaction occurring during the hydrocarbon synthesis. It is also preferred to conduct the reaction under conditions to achieve an alpha of at least 0.85, preferably at least 0.9 and more preferably at least 0.92, so as to synthesize more of the more desirable higher molecular weight hydrocarbons. This has been achieved in a slurry process using a catalyst containing a catalytic cobalt component. Those skilled in the art know that by alpha is meant the Schultz-Flory kinetic alpha. Typical conditions effective to form hydrocarbons comprising mostly $C_{5+}$ paraffins, (e.g., $C_{5+}$–$C_{200}$) and preferably $C_{10+}$ paraffins (and more preferably $C_{20+}$) in a slurry hydrocarbon synthesis process employing a catalyst comprising a supported cobalt component include, for example, temperatures, pressures and hourly gas space velocities in the range of from about 320–600° F., 80–600 psi and 100–40,000 V/hr/V, expressed as standard volumes of the gaseous CO and $H_2$ mixture (0° C., 1 atm) per hour per volume of catalyst, respectively. The hydrocarbons which are liquid at the reaction conditions are removed from the reactor using filtration means.

The FIGURE is a schematic flow diagram of an integrated hydrocarbon synthesis process which includes the hydroisomerization and dewaxing of the waxy feed useful in the practice of the invention. Referring to the FIGURE, a slurry hydrocarbon synthesis reactor 10 containing a three phase slurry 12 inside, has a gas distribution plate 14 at the bottom of the slurry for injecting synthesis gas from the plenum area below and liquid filtration means indicated as box 16, immersed in the slurry. The synthesis gas is passed into the reactor via line 18, with the slurry liquid, which comprises the synthesized hydrocarbons that are liquid at the reaction conditions, continuously withdrawn as filtrate via line 20 and the gaseous reactor effluent removed overhead as tail gas via line 22. The filtrate is passed into a hydroisomerization unit 38. In the reactor, the $H_2$ and CO of the synthesis gas react in the presence of the particulate catalyst to form the desired hydrocarbons, most of which comprise the slurry liquid, and gas reaction products, much of which is water vapor and $CO_2$. The circles in 12 represent the bubbles of synthesis gas and gas products, while the solid dots represent the particulate Fischer-Tropsch hydrocarbon synthesis catalyst. The gaseous overhead comprises water vapor, $CO_2$, gaseous hydrocarbon products, unreacted synthesis gas and minor amounts of oxygenates. The overhead is passed through respective hot and cold heat exchangers 24 and 26, in which it is cooled to condense a portion of the water and hydrocarbons, and into respective hot and cold separators 28 and 30, to recover condensed hydrocarbon liquids. Thus, the gas overhead is passed via line 22 through a hot heat exchanger 24 to condense out some of the water vapor and heavier hydrocarbons as liquid, with the gas and liquid mixture then passed via line 32 into separator 28, in which the water and liquid hydrocarbons separate from the remaining gas as separate liquid layers. The water layer is removed via line 34 and the hydrocarbon liquids removed via line 36 and passed into the hydroisomerization unit 38, along with the filtrate from filter 16. The separated hydrocarbon liquid from the hot separator 28 contains hydrocarbons which solidify at standard conditions of room temperature and pressure, and are useful as part of the waxy feed to the hydroisomerization unit 38. The uncondensed gas is removed from separator 28 and passed via line 40 through cold heat exchanger 26, to condense more water and lighter hydrocarbons as liquid, with the gas and liquid mixture then passed via line 42 into cold separator 30, in which the liquid separates from the uncondensed gas as two separate layers. The water is removed via line 44 and the hydrocarbon liquid via line 46 and into line 48. The uncondensed vapors are removed via line 50. Hydrogen or a hydrogen-containing treat gas is passed into the bottom of the hydroisomerization unit via line 52. The hydroisomerization unit contains a fixed bed 54 of a dual function hydroisomerization catalyst. The downcoming hydrocarbons are hydroisomerized and the mixture of hydroisomerized hydrocarbons and gas is removed from the reactor via line 48 and passed, along with the lighter hydrocarbons from line 46, into a fractionator 56, in which the lighter components are separated as fuel fractions, such as a naphtha fraction removed via line 58, and a jet/diesel fuel fraction removed via line 60, with the unreacted hydrogen from 38 and light hydrocarbon gas removed as tail gas via line 62. The heavier hydroisomerate, comprising the desired hydrocarbons boiling in the lube oil range which have an initial boiling point in the range of from 650–750° F., is removed from the bottom of the fractionator via line 64. Thus, in this embodiment, the lighter portion of the hydroisomerate is separated from the lube oil material before dewaxing. This greatly reduces the load on both the dewaxing unit and subsequent vacuum pipe still. The lube oil fraction is passed via line 64 into a catalytic dewaxing unit 66, which contains a fixed bed 68 of a dewaxing catalyst comprising Pt/H-mordenite. Hydrogen or a hydrogen-containing treat gas is passed into 66 via line 70, and reacts with the hydroisomerate to reduce its pour point and produce a dewaxate comprising a premium lubricant base stock, which is removed, along with unreacted hydrogen and gas products of the dewaxing reaction, via line 72 and passed into a vacuum pipe still 74, via line 72. As is the case with the hydroisomerization, the catalytic dewaxing also results in some of the base stock material being cracked into lower boiling material, to form a light fraction. In the vacuum pipe still, the light fraction is separated from the dewaxed base stock and removed from the unit via line 76, with the dewaxed lube oil base stock removed from the unit via line 78. While only a single stream of base stock is shown for convenience, more typically a plurality of base stocks of different viscosity are produced by the vacuum fractionation. Unreacted hydrogen and light hydrocarbon gases are removed overhead via line 80.

The invention will be further understood with reference to the examples below. In all of these examples, the $T_{90}$–$T_{10}$ temperature spread was greater than 350° F.

EXAMPLES

Example 1

Fischer-Tropsch synthesized waxy hydrocarbons were formed in a slurry reactor from a synthesis gas feed comprising a mixture of $H_2$ and CO having an $H_2$ to CO mole ratio of between 2.11–2.16. The slurry comprised particles of a Fischer-Tropsch hydrocarbon synthesis catalyst comprising cobalt and rhenium supported on titania dispersed in a hydrocarbon slurry liquid, with the synthesis gas bubbled up through the slurry. The slurry liquid comprised hydrocarbon products of the synthesis reaction which were liquid at the reaction conditions. These included a temperature of 425° F., a pressure of 290 psig and a gas feed linear velocity of from 12 to 18 cm/sec. The alpha of the synthesis step was greater than 0.9. The waxy feed, which is liquid at the reaction conditions and which is the slurry was withdrawn from the reactor by filtration. The boiling point distribution of the waxy feed is given in Table 1.

TABLE 1

| Wt. % Boiling Point Distribution of Fischer-Tropsch Reactor Waxy Feed | |
|---|---|
| IBP-500° F. | 1.0 |
| 500–700° F. | 28.1 |
| 700° F.+ | 70.9 |
| 1050° F.+ | 6.8 |

Example 2

The waxy feed produced in Example 1 was hydroisomerized without fractionation and therefore included the 29 wt. % of material boiling below 700° F. shown in Table 1. The waxy feed was hydroisomerized by reacting with hydrogen in the presence of a dual function hydroisomerization catalyst which consisted of cobalt (CoO, 3.2 wt. %) and molybdenum ($MoO_3$, 15.2 wt. %) supported on an amorphous silica-alumina cogel acidic component, 15.5 wt. % of which was silica. The catalyst had a surface area of 266 $m^2/g$ and a pore volume ($P.V._{H2O}$) of 0.64 mL/g. This catalyst was prepared by depositing and calcining the cobalt component on the support prior to the deposition and calcining of the molybdenum component. The conditions for the hydroisomerization are set forth in Table 2 and were selected for a target of 50 wt. % feed conversion of the 700° F.+ fraction which is defined as:

$$700° \text{ F.+ Conv.} = [1-(\text{wt. \% } 700° \text{ F.+ in product})/(\text{wt. \% } 700° \text{ F.+ in feed})] \times 100$$

TABLE 2

| Hydroisomerization Reaction Conditions | |
|---|---|
| Temperature, ° F. (° C.) | 713 (378) |
| $H_2$ Pressure, psig (pure) | 725 |
| $H_2$ Treat Gas Rate, SCF/B | 2500 |
| LHSV, v/v/h | 1.1 |
| Target 700° F.+ Conversion, wt. % | 50 |

As indicated in the Table, 50 wt. % of the 700° F.+ waxy feed was converted to 700° F.– boiling products. The 700° F.– hydroisomerate was fractionated to recover fuel products of reduced cloud point and freeze point.

Table 3 shows the properties of the 700° F.+ hydroisomerate.

TABLE 3

| ° F., Wt. % Boiling Point Distribution by GCD and Pour Point of the 700° F.+ Hydroisomerate Fraction | |
|---|---|
| IBP-320 | 0 |
| 320–500 | 0 |
| 500–700 | 1.6 |
| 700–950 | 86.8 |
| (730° F.+) | (78.3) |
| 950+ | 11.6 |
| Pour Point, ° C. | 2 |
| KV @ 40° C., cSt | 26.25 |
| KV @ 100° C., cSt | 5.07 |
| VI | 148 |

Comparative Example

An Arab light atmospheric resid was fractionated to remove the heavy back end, leaving a 700–1026° F. feed having the properties shown in Table 4. This feed was catalytically dewaxed in the upflow reactor and over the Pt/H-mordenite catalyst of Example 3 to reduce the pour point, but with more severe conditions. The $H_2$ pressure was 1350 psig with a nominal treat gas rate of 5000 SCF/B at 0.5 LHSV and temperature of 570° F. The dewaxing results are also shown in Table 4.

TABLE 4

| Catalytic Dewaxing Results for Hivac Cut Feed (700–1026° F.) | Total | 700–860° F. | 860° F.+ |
|---|---|---|---|
| Yield on feed, wt. % | 100 | 36.2 | 38.9 |
| Feed KV at | | | |
| 40° C., cSt | 26 | | |
| 100° C., cSt | 5 | | |
| VI | 98 | | |
| Pour Point, ° C. | 29 | 27 | 43 |
| 700° F.+ Dewaxate yield on feed, wt. % | 77.1 | 39.3 | 32.9 |
| KV at | | | |
| 40° C., cSt | 41.5 | | |
| 100° C., cSt | 5.7 | | |
| VI | 78 | | |
| Pour Point, ° C. | 18 | −1 | 29 |

The dewaxate was fractionated to separate the lighter fuel fractions produced in the reactor from the Arab Light 700° F.+ dewaxed base stock whose low temperature properties are given in Table 6, along with the properties of the F-T wax base stock prepared according to the process of the invention from Example 3 below.

Example 3

The 700° F.+ hydroisomerate shown in Table 3 was catalytically dewaxed using a 0.5 wt. % Pt/H-mordenite catalyst to reduce the pour point and form a high VI lubricating base stock. In this experiment, a small up-flow pilot plant unit was used. The dewaxing conditions included a 750 psig $H_2$ pressure, with a nominal treat gas rate of 2500 SCF/B at 1 LHSV and a temperature of 550° F. The dewaxate product exiting the reactor was fractionated using the standard 15/5 distillation to remove the lower boiling fuel components produced by the dewaxing and the 700° F.+ product subjected to Hivac distillation to obtain narrow cuts, with low temperature properties measured on the 730–950° F. and 950° F.+ portions. The results are summarized in Table 5.

TABLE 5

| F-T Waxy Hydroisomerate Catalytic Dewaxing Results | |
|---|---|
| Reactor Temperature, ° F. | 550 |
| Yields wt. % | |
| $C_1$–$C_4$ | 11.3 |
| $C_5$–320° F. | 9.1 |
| 320–730° F. | 1.3 |
| 730–950° F. | 59.9 |
| 950° F.+ | 18.4 |
| Total Yield | 78.3 |
| 730–950° F. | |
| Pour Point, ° C. | −26 |
| KV at 40° C., cSt | 17.27 |
| KV at 100° C., cSt | 3.96 |
| VI | 127.3 |
| 950° F.+ | |
| Pour Point, ° C. | |
| KV at 40° C., cSt | 80.19 |
| KV at 100° C., cSt | 11.90 |
| VI | 142.5 |
| Total 700° F.+ Base Stock (dewaxate) | |
| Pour Point, ° C. | −15 |
| KV at 40° C., cSt | 22.76 |
| KV at 100° C., cSt | 4.83 |
| VI | 138.1 |

The properties of the Fischer-Tropsch base stock prepared according to the process of the invention are compared with those of the lube oil base stock derived from the Arab Light feed in Table 6.

TABLE 6

| Comparison of Catalytically Dewaxed 700° F.+ Base Stocks | F-T Waxy HI | Arab Light Feed |
|---|---|---|
| Dewaxing Temp., ° F. | 550 | 570 Base |
| Stock Yield, wt. % | 78.3 | 77.1 |
| Pour Point, ° C. | −15 | 18 |
| VI | 138 | 78 |

The properties of the two base stocks shown above, clearly demonstrate that without hydrotreating, the Fischer-Tropsch wax hydroisomerate catalytically dewaxed over the Pt/H-mordenite dewaxing catalyst, according to the process of the invention, yields a high VI and low pour point base stock, having a lower pour point and higher VI than the conventional, petroleum oil derived lube oil fraction, at about the same feed conversion level. Further, petroleum based base stocks are usually dewaxed as a plurality of specific, narrow fractions or cuts of the 650–750° F.+ material to optimize the base stock yield of each specific cut. The data presented herein demonstrate that this procedure is unnecessary when using the process of the invention with Fischer-Tropsch waxy feeds.

It is understood that various other embodiments and modifications in the practice of the invention will be apparent to, and can be readily made by, those skilled in the art without departing from the scope and spirit of the invention described above. Accordingly, it is not intended that the scope of the claims appended hereto be limited to the exact description set forth above, but rather that the claims be construed as encompassing all of the features of patentable novelty which reside in the present invention, including all the features and embodiments which would be treated as equivalents thereof by those skilled in the art to which the invention pertains.

What is claimed is:

1. A process for producing an isoparaffinic lubricant base stock which is obtained by (i) hydroisomerizing a waxy, normal paraffinic hydrocarbon fraction having an initial boiling point in the range of 650–750° F. obtained from a Fischer-Tropsch hydrocarbon synthesis process to form a hydroisomerate having an initial boiling point in said 650–750° F. range, (ii) catalytically dewaxing said hydroisomerate by reacting it with hydrogen in the presence of a catalyst comprising a catalytic platinum component and a hydrogen mordenite component to reduce its pour point and form a dewaxate which contains hydrocarbons boiling above and below said 650–750° F. range, and (iii) removing said lower boiling material from said dewaxate to form said base stock.

2. A process according to claim 1 wherein said waxy feed is obtained from a slurry Fischer-Tropsch process.

3. A process according to claim 2 wherein said waxy feed comprises at least 95 wt. % normal paraffins and said base stock comprises at least 95 wt. % non-cyclic isoparaffins.

4. A process according to claim 3 wherein said slurry Fischer-Tropsch process employs a hydrocarbon synthesis catalyst comprising a catalytic cobalt component.

5. A process according to claim 4 wherein said hydroisomerization comprises reacting said waxy feed with hydrogen in the presence of a hydroisomerization catalyst having a catalytic metal component and an acidic metal oxide component and both a hydroisomerization function and a hydrogenation/dehydrogenation function.

6. A process according to claim 5 wherein said waxy feed also contains hydrocarbons having an initial boiling point below said 650–750° F. range.

7. A process according to claim 6 wherein said waxy feed has an end boiling point of At least 1050° F. and continuously boils from said 650–750° F. through to said end point.

8. A process according to claim 5 wherein said waxy feed also contains hydrocarbons having an initial boiling point below said 650–750° F. range.

9. A process according to claim 5 wherein said waxy feed has less than 1 wppm of nitrogen compounds, less than 1 wppm of sulfur and less than 1,000 wppm of oxygen in the form of oxygenates.

10. A process according to claim 9 wherein said hydroisomerization catalyst is resistant to deactivation by oxygenates.

11. A process according to claim 1 wherein said waxy feed has a $T_{90}$–$T_{10}$ temperature spread of at least 350° F.

* * * * *